US006022391A

United States Patent [19]

Greenlees et al.

[11] Patent Number: 6,022,391

[45] Date of Patent: Feb. 8, 2000

[54] FILTER ASSEMBLY FOR CLEANING COOLING AIR FOR ENGINES

[75] Inventors: Roy E. Greenlees, Lake Forest, Ill.; Richard Snyder, Gary, Ind.; Kenneth S. Schultz, Evanston; R. Ryan Greenlees, Lake Forest, both of Ill.

[73] Assignee: United Air Filter, Inc., Cicero, Ill.

[21] Appl. No.: 09/240,210

[22] Filed: Jan. 29, 1999

[51] Int. Cl.[7] ..... F02B 77/00

[52] U.S. Cl. ..... 55/385.1; 55/385.3; 55/DIG. 28; 123/41.65; 123/198 E

[58] Field of Search ..... 55/385.1, 305.3, 55/406, DIG. 28; 56/12.8; 123/41.65, 41.7, 41.62, 185.4, 185.2, 198 E; 180/68.1

[56] References Cited

U.S. PATENT DOCUMENTS

| | | | |
|---|---|---|---|
| 2,445,965 | 7/1948 | Packwood | 56/12.8 |
| 2,601,907 | 7/1952 | Burrows et al. | 55/406 |
| 2,736,301 | 2/1956 | Medenus | 123/41.65 |
| 2,848,987 | 8/1958 | Morden | 123/185.4 |
| 2,972,340 | 2/1961 | Bertsch | 123/41.7 |
| 3,147,814 | 9/1964 | Suhre | 180/68.1 |
| 3,183,899 | 5/1965 | Tuggle | 123/41.65 |
| 3,744,468 | 7/1973 | Braun | 123/185.2 |
| 3,994,067 | 11/1976 | Hazzard et al. | 55/385.3 |
| 4,134,370 | 1/1979 | Iwahashi et al. | 123/41.31 |
| 4,261,302 | 4/1981 | Sheldon | 123/41.7 |
| 4,438,733 | 3/1984 | Sassaki | 123/41.62 |
| 4,446,681 | 5/1984 | Dynie et al. | 123/41.65 |
| 4,770,262 | 9/1988 | Yasunaga et al. | 123/41.65 |
| 4,946,482 | 8/1990 | Tamba et al. | 55/DIG. 28 |
| 4,970,993 | 11/1990 | Weiss et al. | 123/41.7 |
| 4,998,510 | 3/1991 | Rognon | 123/41.7 |
| 5,167,209 | 12/1992 | Dufern et al. | 123/198 E |

*Primary Examiner*—David A. Simmons
*Assistant Examiner*—Minh-Chau T. Pham
*Attorney, Agent, or Firm*—Marshall, O'Toole, Gerstein, Murray & Borun

[57] ABSTRACT

An engine filter assembly for cleaning cooling air for an internal-combustion engine for use in high-debris environment such as in roofing-removing machines includes a protective element housing attached to the machine at a remote position. The protective element housing houses a two-stage air filter having a cylindrical-shaped filter element with an outer pre-filter covering. An air inlet housing on the engine is connected to the protective element housing by a flexible coupling link. A shield protects the engine from direct contact with loose or air-born materials during the operation of the machine. A thermal sensing device reads the temperature of the engine and automatically shuts down the engine if the temperature elevates beyond specification, reducing the chance of engine failure.

14 Claims, 3 Drawing Sheets

FILTER ASSEMBLY FOR CLEANING COOLING AIR FOR ENGINES

BACKGROUND OF THE INVENTION

This invention relates in general to protection of internal combustion engines to reduce overheating and subsequent engine failure, and more particularly to protection of small engines used in high-debris environments such as in roof-removing machines.

U.S. Pat. No. 5,167,209 illustrates such a roof-removing machine. U.S. Pat. Nos. 2,445,965; 2,601,907; 2,736,301; 2,848,987; 2,972,340; 3,147,814; 3,183,899; 3,252,449; 3,744,468; 3,994,067; 4,134,370; 4,261,302; 4,438,733; 4,446,681; 4,770,262; 4,946,482; 4,970,933; 4,998,510; and 5,167,209 illustrate various filtering arrangements for air-cooled engines.

When operated in dirty environments, such as in roof removing machines, air-cooled engines often overheat because debris drawn into the air cooling intake coats the fan blades and cooling fins, reducing heat dissipation, and clogging the air intake. The reduced efficiency of the cooling system in turn causes the engine to overheat, creating a high potential for engine failure. Although various screens and filters have been provided for engines, adequate filtration is not available for engines of this type used in high debris environments.

SUMMARY OF THE INVENTION

The present invention relates to an improved filtering assembly for such engines.

A two-stage air filter is housed within a protective element housing that is disposed remotely from the engine. The filter element consists of a cylindrical-shaped filter element surrounded by a pre-filter. The pre-filter prevents larger particulate from entering the filter element, while the main filter element removes fine particulates. The pre-filter extends the life of the main air filter at a lower cost. As the pre-filter becomes clogged, it can be easily replaced while the filter element is used for an extended period of time.

The protective element housing has a circular exit that is substantially identical in circumference to that of the inlet on an air inlet housing on the engine. A flexible coupling link connects the protective element housing to the air inlet housing. The coupling link is made of flexible material to dampen vibration during operation of the engine and to facilitate a sealed fit at either end when secured with an annular clamp.

To further protect the engine, a shield may be strategically placed to prevent materials emitted during the operation of the machine from coming in direct contact with the engine. A thermal sensing device may also be used to read the temperature of the engine and shut down or turn off the engine should the temperature rise beyond a specified limit.

Other objects, features, and advantages of the invention will be readily apparent from the following description of certain preferred embodiments, in which:

DETAILED DESCRIPTION OF THE DRAWINGS

Figure 1:
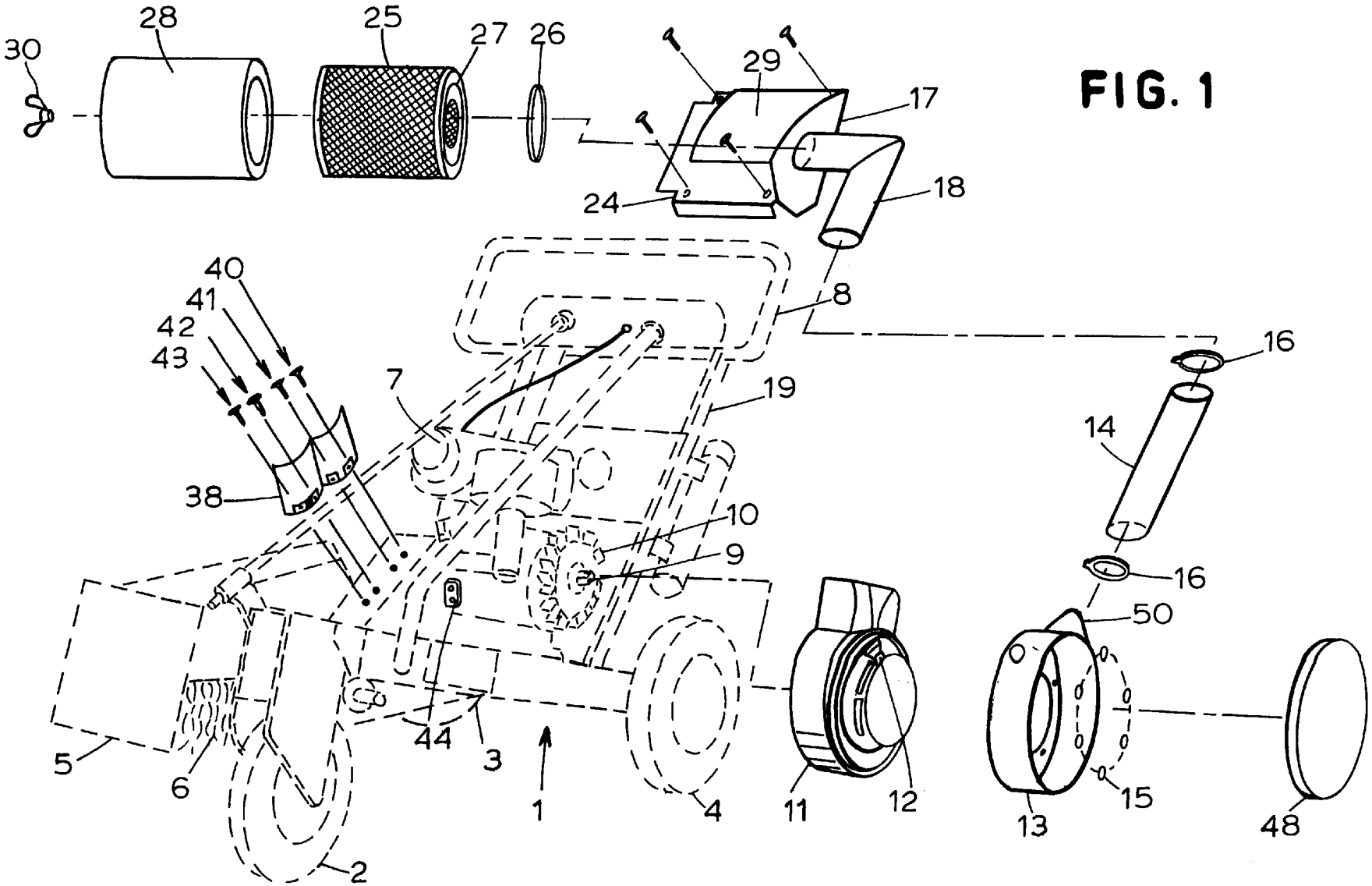
FIG. 1 is an exploded perspective view of an embodiment of a filter assembly in accordance with the present invention.

FIG. 1 illustrates one embodiment of a roofing removal machine 1 in connection with which the invention may be used. Conventionally, the machine moves upon ground wheels 2, 3, and 4, and has cutting blades 6 designed to cut roofing material. A handle 8 is used the steer the machine. The cutting blades 6 are driven by an internal combustion engine 7. The engine 7 has a crankshaft 9, which is attached to and drives a cooling fan 10. The cooling fan 10 draws air to the engine 7 and forces the air over the surface of the engine for cooling. A fan housing 11 covers both the cooling fan 10 and a manual recoil starter 12 that can be used to start the engine 7.

Unlike in conventional roof-cutting machines, the machine also has a protective element housing 17 that is attached to frame members 19 of the roofing removal machine 1 near the handle 8, remotely from the cutting blades 6. Preferably, the protective element housing is disposed at least about two feet from the cutting blades, and at least about two feet above the ground. The protective element housing may be attached to the frame members in any conventional way, such as by bolts 20, 21, 22, and 23. As illustrated here, an alignment flange 24 fits between the frame members, assisting in alignment of the bolts.

The protective element housing 17 protects a filter comprised of an air filter element 25 and a pre-filter 28 that can be used to provide appropriate low restriction air filtration with structural stability. Disposing these elements within the protective element housing protects the filter from normal abuse and environmental conditions. Positioning the filter near the handle 8 facilitates easy servicing. The remote location, elevated above the cutting blades 6, also reduces the load on the filter because particulate matter created during machine operation generally rises only a certain height before returning to the surface level or being carried off by air movement. With the filter located at an elevated level, the amount of particulate matter to be filtered from the air is reduced, extending the useable life of the filter.

Figure 2:
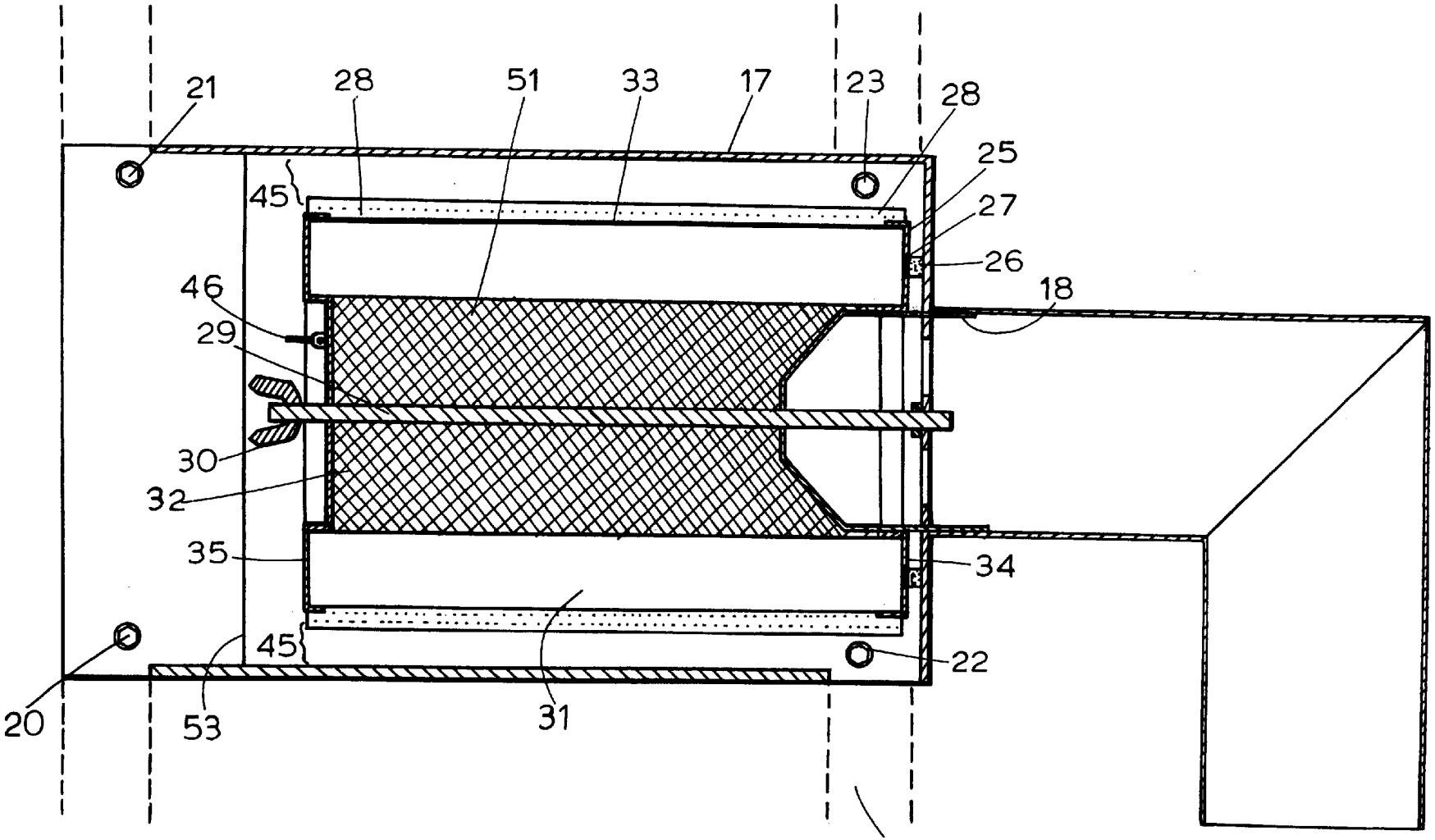
FIG. 2 is an enlarged top cross-sectional view of the protective element housing and two-stage filter of the assembly of FIG. 1.
Figure 3:
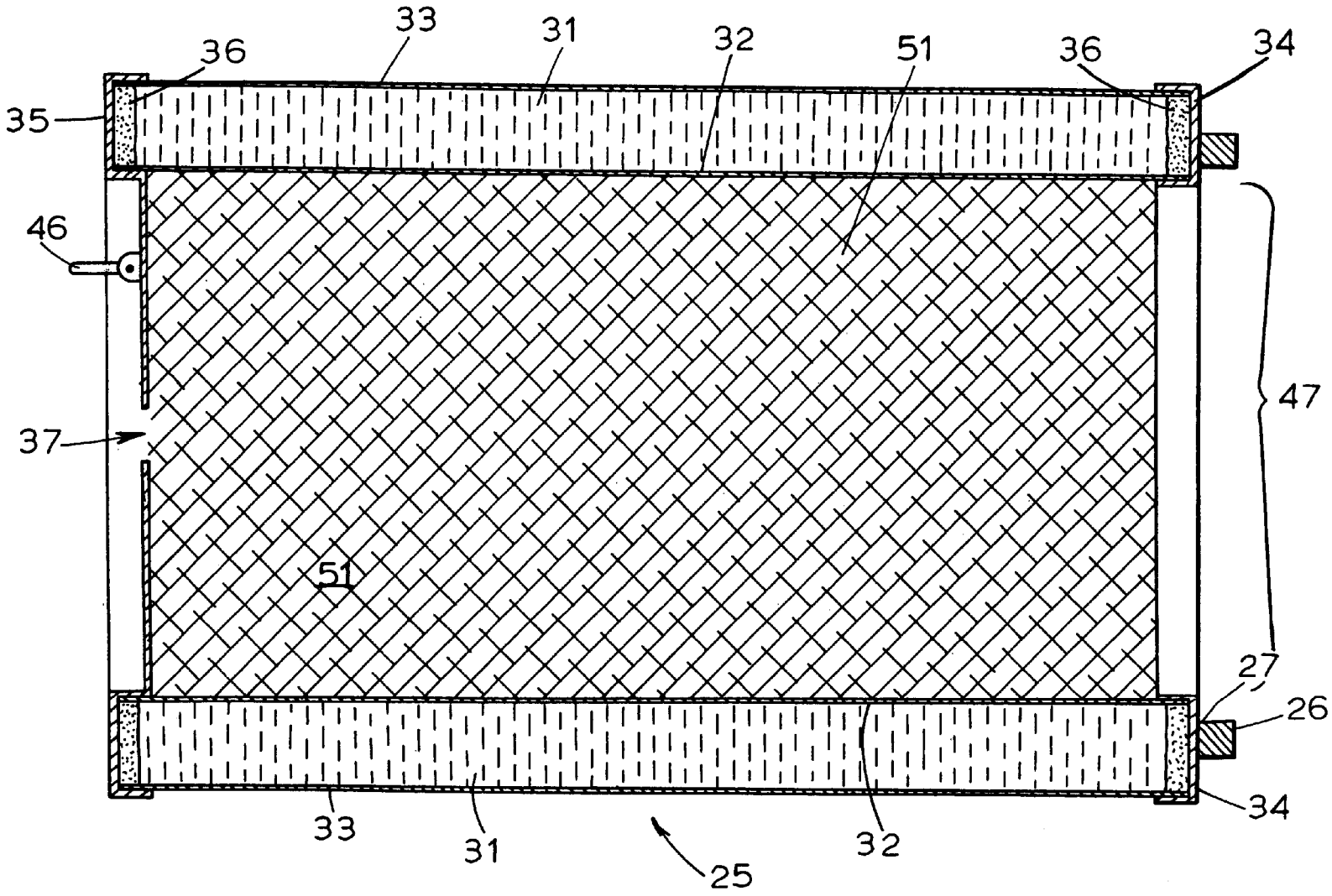
FIG. 3 is a further enlarged sectional view of the filter of FIG. 2.

FIGS. 2 and 3 illustrate the details of the illustrated filter element 25 and pre-filter 28. The filter element includes an inner screen 32 that can be constructed of any conventional screening medium such as plastic, metal, and the like. A pleat pack 31 (also referred to as the filtering medium) constructed of any of a range of conventionally-known filter media is formed in a substantially tubular shape about the inner screen. The pleat pack has accordion folds about its perimeter that extend the full length of the pleat pack 31 to create adjoining filter walls, thereby substantially increasing the filtering area of the pleat pack 31. The outer perimeter of the filter element 25 is supported by an outer screen 33 having a similar but greater circumference than the inner screen 32. The inner screen 32 and outer screen 33 extend the life of the pleat pack 31.

A suitable potting compound 36, such as plastisol, polyurethane, or silicone, is used to secure the ends of the pleat pack 31, the inner screen 32, and the outer screen 33 into both a top end cap 34 and a bottom end cap 35. Both the top end cap 34 and the bottom end cap 35 may be constructed from one or more components using any suitable metal or resin compound. The top end cap 34 includes a discharge port 47 (FIG. 3) from an interior filter chamber 51. An annular-shaped gasket 26 is attached to the top end cap 34 of the filter element 25 with an adhesive material 27.

A replaceable, expandable pre-filter 28 fits over the filter element 25 in a snug friction fit, forcing air to be drawn through the pre-filter 28 prior to entering the filter element 25. The fit between the filter element 25 and the pre-filter 28 is preferably sufficiently snug so that the pre-filter will not move during operation of the machine 1.

The assembly of the filter element 25 and the pre-filter 28 may be removably inserted into the protective element housing 17 by sliding the filter element and pre-filter into the protective element housing through an open end 53 (FIG. 2). Sufficient clearance 45 between the pre-filter 28 and the protective element housing 17 permits the desired air flow to the exterior surface of the pre-filter. When seated properly, the discharge port 47 (FIG. 3) from the interior filter chamber 51 is in fluid communication with an exit tube 18 (FIG. 2) on the protective element housing 17.

A hole 37 in the bottom end cap 35 (FIG. 3) enables the filter element 25 to be securely mounted to a threaded yoke 29 (FIG. 2) in the protective element housing 17. In the illustrated embodiment of the invention, the yoke projects through the hole when the filter element is seated properly, and a wingnut 30 may be threaded over the end of the yoke 29 to secure the filter element in position. Tightening the wingnut 30 onto the yoke 29 compresses the gasket 26 on the top end cap 34 against the protective element housing, creating an air tight seal that prevents air from passing through the open end 53 of the protective element housing to the exit tube 18 without first passing through the pre-filter 28 and the filter element 25.

For replacing a dirty filter element or pre-filter, a pull ring 46 on the bottom end cap 35 provides a simple means for removing the filter element 25 and the pre-filter 28 from the protective element housing 17 after the wingnut 30 is removed.

As illustrated in FIG. 1, an air inlet housing 13 and a flexible coupling link 14 place the protective element housing 17 in fluid communication with the engine 7, creating a continuously sealed system.

The flexible coupling link 14 has one end that is designed to mate with the exit tube 18 on the protective element housing 17. As illustrated, the flexible coupling link is a tube, with a uniform cross-sectional area across its length, and both the exit tube and the end of the flexible coupling link have circular cross-sections. The flexible coupling link may be slipped over the exit tube and sealed with an annular clamp 16.

The other end of the flexible coupling link 14 is attached to the air inlet housing 13. The air inlet housing is attached to the fan housing 11 on the engine 7 by a standard bolt/nut arrangement 15, and serves to collect and directs air to the cooling fan 10. As illustrated, the air inlet housing covers the recoil starter 12. Access to the recoil starter is preserved through the use of a removable housing cover 48.

The air inlet housing 13 has an inlet side opening 50 which provides the only source of air to the cooling fan 10 when the machine is in use. Preferably, the inlet side opening is configured in the same way as the exit tube 18 on the protective element housing 17, enabling the end of the flexible coupling link to be secured in the same way. As illustrated, the flexible coupling link is slipped over the inlet side opening and secured with another annular clamp 16. The flexibility of the coupling link facilitates connection despite alignment errors, and dampens vibrations while the engine is operating.

A shield 38 (FIG. 1) designed for easy removal and cleaning may be attached to a cutting blade guard 39 on the engine 7 with four bolts 40, 41, 42 and 43. The shield minimizes the extent to which roofing material deposits adhere to the engine 7 during operation of the cutting blades 6.

A thermal sensing device 44 may be connected to the cylinder head and spark plug of the engine 7. The thermal sensing devise monitors the temperature of the engine and shuts down or turns off the engine if the temperature elevates beyond a specified temperature, reducing the potential for engine failure.

Modifications and alternative embodiments of the invention will be apparent to those skilled in the art, without departing from the spirit of the invention.

We claim:

1. A filter assembly for cleaning cooling air for engines, the assembly comprising:

an air inlet housing comprising means for collecting and directing air flow to a cooling fan on an engine;

a protective element housing with means for securing the protective element housing on a machine, remote from the engine;

a flexible coupling link linking the air inlet housing to the protective element housing; and a filter disposed within the protective element housing.

2. A filter assembly in accordance with claim 1, in which the flexible coupling link has a uniform cross-sectional area.

3. A filter assembly in accordance with claim 1, in which the air inlet housing has an inlet side opening with the same circumference as an exit tube on the protective element housing.

4. A filter assembly according to claim 1, in which the flexible coupling link comprises means for correcting imperfections in alignment between the air inlet housing and the protective element housing.

5. A filter assembly in accordance with claim 1, in which an annular gasket is disposed between the protective element housing and the filter.

6. A filter assembly in accordance with claim 1, in which the filter comprises a pleated media potted into an endcap and covered with a replaceable pre-filter.

7. A engine assembly in accordance with claim 1, in which the filter has a pull ring.

8. An engine filter assembly according to claim 1, and further comprising a thermal sensing device comprising means for sensing the temperature of a cylinder head of an engine and for shutting down the engine when the temperature of the cylinder head elevates to a specified temperature.

9. A filter assembly according to claim 1, in which the air inlet housing comprises means for providing sealable access to a recoil starter.

10. A filter assembly according to claim 1, in which the protective element housing is made of carbon steel.

11. A filter assembly in accordance with claim 1, and further comprising a shield with means for mounting the shield to a guard on an engine and for protecting the engine from debris raised by operation of the engine.

12. A filter assembly in accordance with claim 1, in which the filter comprises a separately-replaceable pre-filter.

13. A machine for use in dirty environments, including:

the engine filter assembly of claim 1;and an internal combustion disposed remote from the engine filter assembly.

14. A cutting machine comprising:

an engine with a cooling fan;

a handle remote from the engine;

cutting blades mechanically connected to the engine;

an air inlet housing comprising means for restricting air flow to the cooling fan;

a protective element housing disposed near the handle;

a flexible coupling link linking the air inlet housing to the protective element housing; and a filter disposed within the protective element housing.

* * * * *